United States Patent [19]

Gebelin

[11] 4,004,698

[45] Jan. 25, 1977

[54] DEVICE FOR POSITIONING A MEMBER ON A TUBULAR PLATE

[75] Inventor: Bernard Gebelin, Courbevoie, France

[73] Assignee: Societe Franco-Americaine de Constructions Atomiques-Framatome, Courbevoie, France

[22] Filed: Dec. 2, 1975

[21] Appl. No.: 636,951

[30] Foreign Application Priority Data

Dec. 5, 1974 France ..... 74.39771

[52] U.S. Cl. ..... 214/1 BB; 165/76; 214/1 CM

[51] Int. Cl.[2] ..... B25J 9/00

[58] Field of Search ..... 214/1 BB, 1 CM; 165/76

[56] References Cited

UNITED STATES PATENTS

| | | | |
|---|---|---|---|
| 3,811,320 | 5/1974 | Cowell | 214/1 CM X |
| 3,889,820 | 6/1975 | Ranger | 214/1 BB |
| 3,913,752 | 10/1975 | Ward | 214/1 BB |

*Primary Examiner*—Frank E. Werner
*Assistant Examiner*—George F. Abraham

[57] ABSTRACT

A device for use in positioning a member, e.g. an eddy-current probe, in each tube of a regular array of tubes supported by a tube plate, e.g. the bundle of tubes of a steam generator, the member being guided into the tube by an open ended guide tube placeable opposite the selected tube, the device comprising a carriage having two perpendicular arms, means for moving the arms relative to each other in three perpendicular directions of which one is perpendicular to the plane of the plate and two are parallel to the plane of the plate, the amplitudes of the relative movements of the arms in the directions parallel to the plane of the plate being whole number multiples of the pitch of the tube array, guide tubes, the open end portions of which are supported by the arms, grappler means associated with each arm and comprising members for holding the device relative to the array of tubes and comprising grappler members adapted to enter at least partially into a tube support by the plate, means for operating the grappler members, and means for remotely controlling operation of the device.

7 Claims, 5 Drawing Figures

DEVICE FOR POSITIONING A MEMBER ON A TUBULAR PLATE

The invention relates to a device for positioning a member in a tube of a regular array of tubes. It is particularly but not exclusively applicable to the positioning of a probe successively in all the tubes of a bundle of tubes of a steam generator for a nuclear power station.

The very large number of tubes of a bundle of tubes of a steam generator in a pressurized-water nuclear power station must be periodically checked in order to detect possible corrosion. This checking is usually carried out by an eddy-current probe which is engaged successively in each of the tubes and connected to an ordinary apparatus for processing the signal from the probe. The probe is arranged in a flexible guide-tube brought successively opposite each of the tubes of the bundle to be checked. When the opening of the guide tube is correctly centred over one of the tubes of the bundle the probe is propelled into the tube by, for example, compressed air, and then withdrawn ready for insertion in another tube.

Obviously the time necessary for checking all of the tubes of the bundle must be reduced to a minimum in order to reduce the standstill time of the generator. On the other hand one is here in a strongly radioactive domain and it is absolutely obligatory to reduce human intervention to a minimum.

Hitherto devices have been employed in which the open end of the flexible guide-tube is supported by a carriage capable of being displaced in two perpendicular directions along guides which have to be introduced through the manholes in the waterbox at the end of the bundle and attached to the plate. However because the steam generator has to withstand pressure it is of cylindrical shape and the tube-plate is circular. This means that with its two perpendicular motions the carriage cannot sweep the whole of the area, enabling the probe to enter all the tubes, without modifying the orientation of the fixed guides a number of times. Thus it is necessary for the operator to enter the waterbox, that is to say, a zone of dangerous radioactivity, a number of times. It is just the same where the tubes of the bundle are U-tubes and the waterbox is divided into two chambers, with the result that the carriage only has to sweep the area of a semicircle.

According to the present invention, there is provided a device for use in positioning a member successively in each tube of a regular array of tubes supported by a tube plate, the member being guided into the tube by an open ended guide tube placeable opposite the selected tube, the device comprising a carriage having two perpendicular arms, means for moving the arms relative to each other in three perpendicular directions of which one is perpendicular to the plane of the plate and two are parallel to the plane of the plate, the amplitudes of the relative movements of the arms in the directions parallel to the plane of the plate being whole number multiples of the pitch of the tube array, guide tubes, the open end portions of which are supported by the arms, grappler means associated with each arm and comprising members for holding the device relative to the array of tubes and comprising grappler members adapted to enter at least partially into a tube supported by the plate, means for operating the grappler members, and means for remotely controlling operation of the device.

The invention will now be described in greater detail with reference to an embodiment thereof, given by way of example only, with reference to the accompanying drawings. In the drawings.

Figure 1:
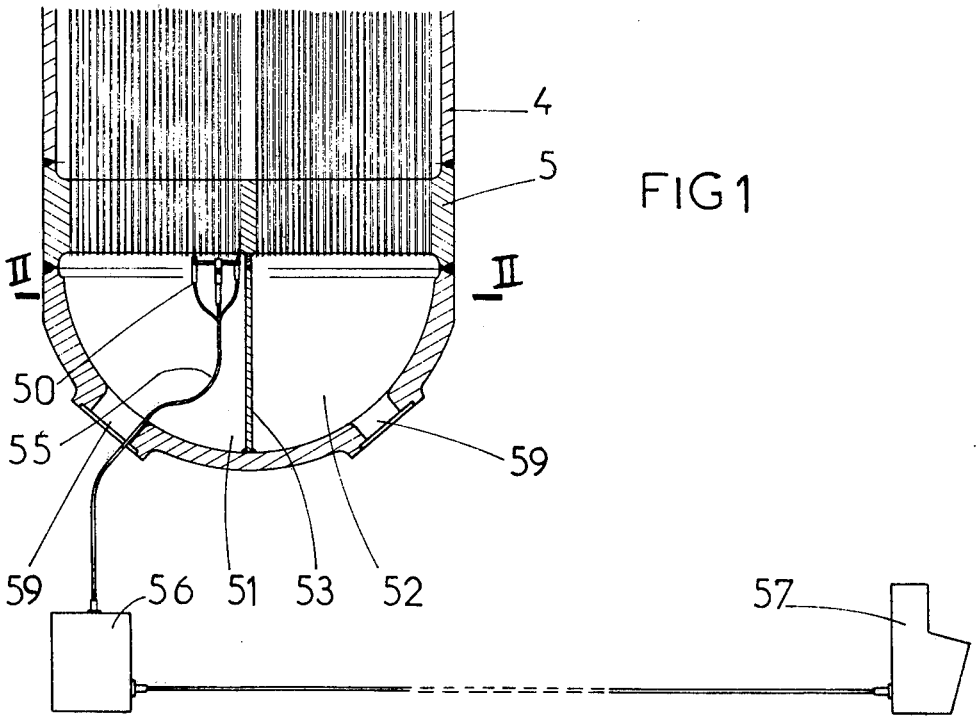
FIG. 1 is a simplified view of a device in accordance with the invention in position in the waterbox of a steam generator.
Figure 3:
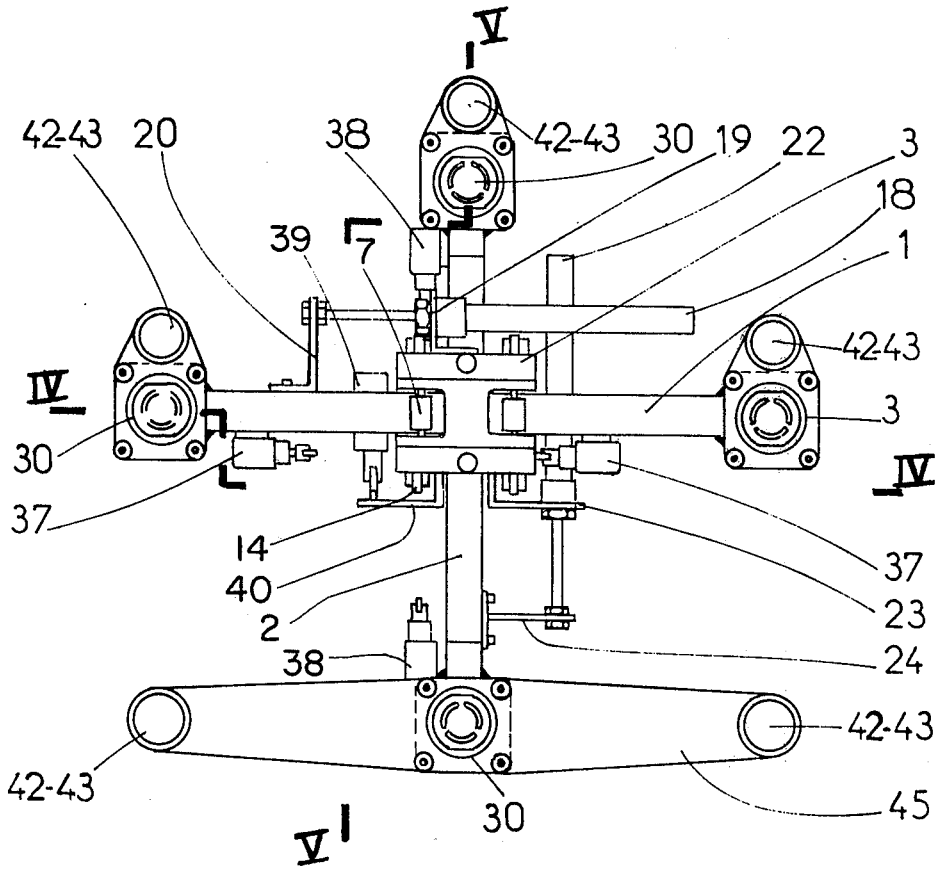
Figure 4:
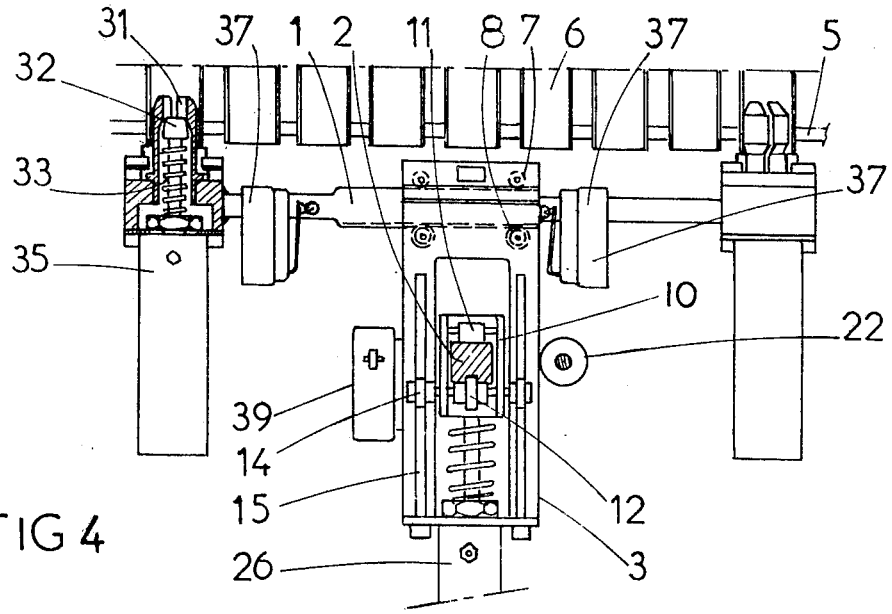
Figure 5:
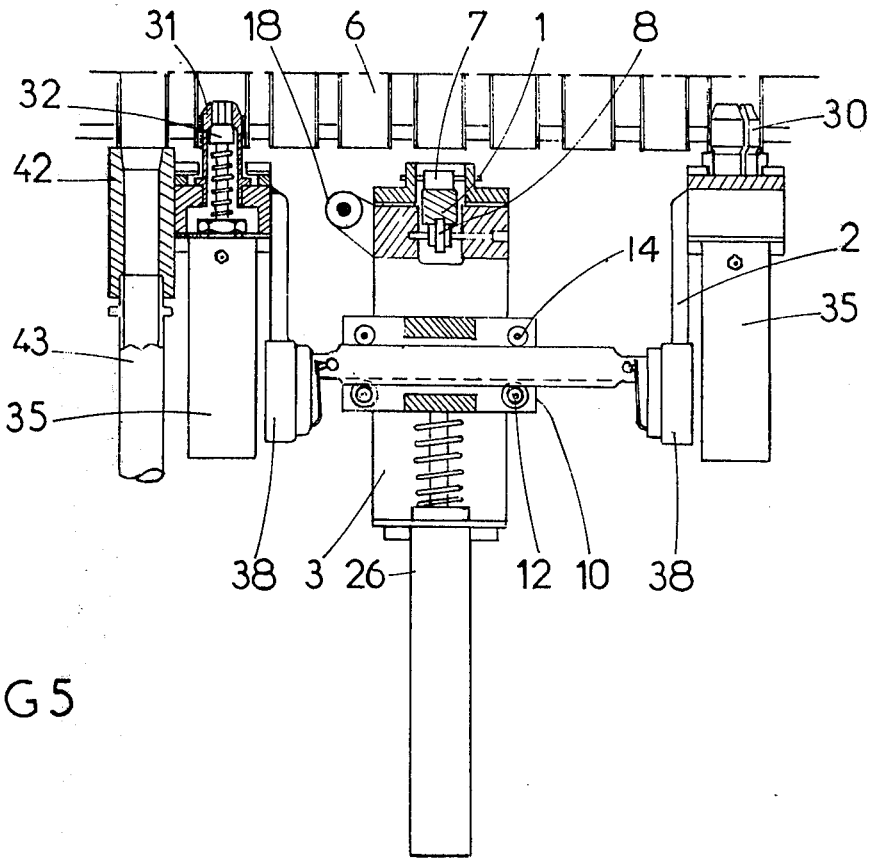

FIGS. 3, 4 and 5 give the detail of the device of FIG. 1. FIG. 3 is a view of the side which faces the tube-plate. FIG. 4 is a view along the line IV—IV of FIG. 3, partially in section. FIG. 5 is a section along the line V—V of FIG. 3, partially in section.

Referring first to FIGS. 3, 4 and 5, there is shown a device comprising a movable carriage including two perpendicular arms 1 and 2, each of which is engaged in a guide and connector stirrup 3. The arm 1 of general rectilinear shape slides freely in one window in the stirrup adjacent the tube-plate 5. In its motion of translation in the window the arm 1 is guided by two flat rollers 7 and two flanged rollers 8.

The arm 2 has a generally U-shaped, the central rectilinear portion of which slides freely in a secondary carriage 10 in which it is guided in the same way as arm 1 by two flat rollers 11 and two flanged rollers 12. The carriage 10 is in turn movable in the stirrup 3 and is guided by flanged rollers 14 which engage in mating grooves 15 in the stirrup.

The motion of the arm 1 with respect to the stirrup 3 is controlled by a jack 18 attached to a bracket 19 fixed to the stirrup, the rod of which is attached to a bracket 20 fixed to the arm. In the same way the motion of the arm 2 with respect to the carriage 10 is controlled by a jack 22 attached to a bracket 23 fixed to the carriage, the rod of which is attached to a bracket 24 fixed to the arm. Finally, the motion of the carriage 10 in the stirrup is controlled by the jack 26 the body of which is attached to the stirrup and the rod of which is attached to the carriage.

At each of their ends the two arms 1 and 2 carry an expansible grappler mandrel 30 consisting of a portion of tube 31 split into three lobes and having an outer diameter slightly smaller than the inner diameter of the tubes 6 of the bundle. The lobes of tube 31 are subjected to the action of an inner core 32 which, under the action of the spring 33, tends to spread them and thus increase the diameter of the mandrel. The core 32 is attached to the rod of a jack 35 capable, by compressing the spring 33, of annulling the force of expansion of the tube 31.

The travel of the arms 1 and 2 in the stirrup 3 and the carriage 10 respectively is limited to the pitch of the tubes 6 across the plate 5, by end-of-travel contacts 37 on the arm 1 and 38 on the arm 2. Finally, the position of the carriage 10 in the stirrup 3 is controlled by a contact 39 fixed to the stirrup and a cooperating cam 40 fixed to the carriage 10. The cam 40 can depress the contact 39 only when the carriage 10 is in mid-travel in the stirrup 3 as shown in the Figures and in this position the four mandrels 30 are all in one and the same plane.

The carriage supports the ends 42 of five guide-tubes 43. Two guide-tubes 43 are arranged one at each of the ends of the arm 1 in the vicinity of the expansible mandrels 30. The arm 2 also supports one guide-tube at one of its ends but at the other end it supports two guide-tubes arranged at the ends of a perpendicular auxiliary arm 45. All the centredistances on one and the same arm, between mandrels, between guide-tubes or between a mandrel and a guide-tube, are exact multiples of the pitch between the tubes 6 in the bundle.

Figure 2:
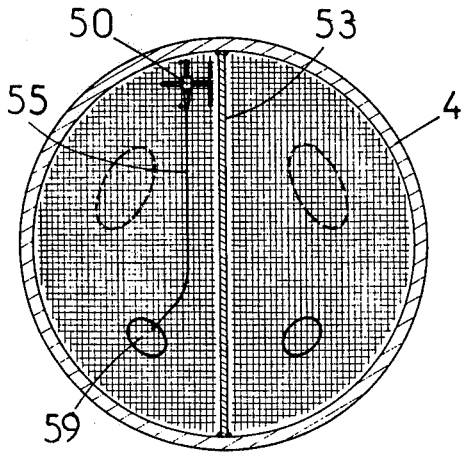
FIG. 2 is a view on the line II—II of FIG. 1.

Referring now to FIGS. 1 and 2 the device designated as a whole by 50 is seen in position on the tube-plate 5 of a steam generator 4. Here the waterbox of the generator is divided into two chambers 51 and 52 by a partition 53 and the carriage 50 will be employed for sweeping one half of the tube-plate, that is to say, the area of a semicircle. The guide-tubes 43, the pipework for feeding the jacks 18, 22, 26 and 35, and the electrical connections from the end-of-travel contacts are brought in a flexible bundle 55 out to a pneumatic and electrical apparatus cabinet 56 arranged adjacent the generator. The cabinet 56 is in turn controlled from a console 57 arranged outside the zone of dangerous radioactivity.

During a programmed stoppage of the generator and as soon as access to the waterbox is possible, the carriage 50 connected pneumatically and electrically to the cabinet 56 is introduced by hand through a manhole 59 and moved up against the tube-plate 5 forming the roof of the waterbox. In this operation the jacks 35 of the expansible mandrels are supplied with compressed air so that the four contracted mandrels can easily be engaged each in one tube of the bundle. The feed to the jacks is then cut off and the carriage is locked on to the plate by its four grappler mandrels. The waterbox can then be vacated after care has been taken to make fast the connections 55 to the carriage at the level of the manhole, leaving sufficient slack for the carriage to be free to move across the whole of the plate.

Movement of the carriage 50 across the tubeplate is effected in the following manner. By supplying compressed air to, for example, the two jacks 35 at the ends of the arm 2, the two corresponding expansible mandrels are unlocked and by operating the jack 26 the carriage 10 can be separated from the plate to withdraw the mandrels on the arm 2 from the tubes in which they had been engaged; in this operation the stirrup 3 continues to bear against the plate by means of the arm 1 which is held to the plate by its own expansible mandrels. When the two mandrels on the arm 2 have been withdrawn from the tubes the jack 22 is operated to displace the arm 2 in translation in the carriage 10 by a distance equal to one pitch of the bundle, then by operation of the jack 26 the expansible mandrels on the arm 2 are re-engaged in two new tubes of the bundle and the mandrels are again locked by releasing the pressure in the jacks 35. One can then make a similar manoeuvre by this time releasing the arm 1, then disengaging it and making it advance likewise one pitch, the device being supported this time by the arm 2 which is held on the tube bundle. It can easily be imagined that by suitably chosen sequences of operation of the jacks 18 or 22 after release and disengagement of one or other of the arms 1 or 2 the carriage can be displaced, each time by one pitch in one direction or in a perpendicular direction, with the result that one or other of the openings 42 in the guide tubes 43 will always be brought opposite one of the tubes 6 in the tube bundle.

In practice when the carriage is held against the tube-plate, care being taken that the auxiliary arm 45 is parallel with the partition 53, its advance is controlled from the console 57 until it is brought into a corner or extremity of the tube plate as illustrated, for example, in FIG. 2. Each movement of one or other arm by one pitch is indicated by a change of state of the end-of-travel contacts 37 or 38, so that by adding and subtracting the pulses received through these contracts the position of the carriage on the plate can be located with respect to two rectangular coordinates. As shown, when the carriage 50 is in the corner position shown in FIG. 2 the position-indicating adders-substractors are set to zero for starting a sweep-cycle. Depending upon the end in view, displacement of the carriage can be programmed by automatic sequences of operation of the jacks, with of course safety interlocks so that execution of the order for displacement of one arm is possible only if the other arm has ended its complete cycle and if authorization of it is given by a contact external to the system, which contact indicates that the probe has been withdrawn from the tube being checked. The sequences of movement for the automatic displacement of the carriage and the interlocks necessary for satisfactory execution of these displacements are not described here in detail because they can be very easily worked out by a technician specialized in automation.

By these automatic displacements of the carriage it is possible both to ensure systematic sweeping of the whole area of the tube-plate in question and to have the carriage displaced towards one tube defined by two rectangular coordinates.

At the end of operation it is sufficient to support the carriage by hand and then cause release of all the expansible mandrels in order to disengage the carriage from the plate and withdraw it through the manhole.

It will be seen that during the whole operation it was only necessary for an operator to enter the waterbox twice, these two interventions being of very short duration since the carriage can be put in position at any point on the plate and, for withdrawing it, it is sufficient to support it during its release.

There is thus provided a device which can move the guide tubes of the eddy current detectors over the whole of the area of the tube-plate so that access can be had by the eddy-current detectors to all the tubes whilst limiting intervention by the operator to only one putting of the device in position and only one withdrawal of the device. Between these two starting and finishing operations all the movements of the device are remote-controlled from outside the zone of dangerous radioactivity.

Of course the invention is not intended to be strictly confined to the embodiment which has been described by way of example but likewise covers embodiments which might differ from it only in detail, in variants of execution or in the employment of equivalent means. Thus, depending upon the actual form of the tube-plate to be explored a different distribution of the guide-tubes on the arms 1 and 2 may be used; in particular, for example, if the whole of a circular plate is to be explored one guide-tube may be provided at each end of the arm 2 instead of having the two guide-tubes at the ends of the arm 45 as described. Alternatively, each arm 1 and 2 may carry at its ends two guide-tubes separated by a whole multiple of the pitch of the tubes of the bundle on the plate.

What is claimed is:

1. A carriage for selectively moving along a tubular plate guide tubes having members adapted to be introduced into tubes of the tubular plate, said carriage comprising: two crossed arms each carrying guide tubes; a guiding and connecting stirrup between said arms, guide means for permitting movement of each arm relative to the stirrup in a direction parallel to the tubular plate, in a longitudinal direction of the arm and in a direction perpendicular to the plate; means for controlling the movements of said arms relative to said stirrup; and said members comprising grappler fingers unitary with each of said arms and directed toward said tubular plate, said fingers comprising expansible mandrels with means for selectively causing their diameter to become greater or smaller than the diameters of the tubes of the plate.

2. A carriage according to claim 1 including remote-control means for automatic control of the jacks for moving the arms and for operation of the grappler fingers in accordance with predetermined sequences, and interlocking means for preventing untoward movements.

3. A carriage according to claim 1 and an array of tubes bounded by a rectilinear portion, one of the arms supporting at one of its ends a perpendicular auxiliary arm, said auxiliary arm supporting a guide-tube at each end.

4. A carriage according to claim 1, including end-of-travel contacts for detecting relative movements of the arms.

5. A carriage according to claim 4, including pulse adding and subtracting means connected to said contacts for determining the position of the carriage.

6. A carriage according the claim 1, wherein said means for varying the diameters of the expansible mandrels of the grappler fingers comprises a spring for increasing the diameter and a single-acting pneumatic jack for retracting the spring and hence decreasing the diameter.

7. A carriage according to claim 1, wherein said means for controlling the movements of said arms comprises double-acting pneumatic jacks for movements parallel to the plate and for movements perpendicular to the plate.

* * * * *